United States Patent [19]

Ohmori et al.

[11] 4,033,854

[45] July 5, 1977

[54] ELECTRICAL INSULATING OILS

[75] Inventors: Tadashi Ohmori, Yokohama; Tokuo Fujisou, Kawasaki, both of Japan

[73] Assignee: Nippon Oil Company, Ltd., Tokyo, Japan

[22] Filed: Dec. 1, 1975

[21] Appl. No.: 636,391

[30] Foreign Application Priority Data

Dec. 2, 1974 Japan ..... 49-136983
Sept. 26, 1975 Japan ..... 50-115682

[52] U.S. Cl. ..... 208/14; 208/97; 252/63

[51] Int. Cl.[2] ..... C10G 39/00; H01B 3/22

[58] Field of Search ..... 208/14, 97; 252/63

[56] References Cited

UNITED STATES PATENTS

| | | | |
|---|---|---|---|
| 2,846,372 | 8/1958 | Schneider et al. | 208/14 |
| 2,921,011 | 1/1960 | Ordelt et al. | 208/14 |
| 3,617,473 | 2/1970 | Lipscomb | 208/14 |

*Primary Examiner*—Herbert Levine
*Attorney, Agent, or Firm*—Frank J. Jordan

[57] ABSTRACT

An electrical insulating oil having excellent oxidation stability, thermal stability and/or hydrogen absorbability consisting essentially of (A) a base hydrocarbon oil obtained by hydrofining and then dewaxing a fraction boiling at 280°–400° derived from a paraffin or mixed base crude oil, (B) a highly aromatic hydrocarbon oil obtained by hydrofining and/or distilling a heavy hydrocarbon fraction boiling at 250°–400° C produced as a by-product at the time of catalytically reforming naphtha or the like and, if desired, (C) an oil obtained by treating a lubricating oil fraction boiling at 230°–500° C derived from a crude petroleum oil.

21 Claims, No Drawings

ELECTRICAL INSULATING OILS

This invention relates to a novel electrical insulating oil consisting essentially of (A) a mineral oil obtained by subjecting a paraffin base crude oil or a mixed base crude oil to predetermined refining treatments, (B) a highly aromatic hydrocarbon oil obtained by hydrofining a heavy reformed oil produced as a by-product by the catalytic reforming of hydrocarbons such as naphtha and, if desired, (C) a refined oil obtained by treating a lubricating oil fraction of a mineral oil with a solid adsorbent.

Various insulating oils have heretofore been marketed, and the quantitatively greater part thereof has been of a mineral oil type. The reason for this is that as compared with insulating oils obtained by synthesis, mineral oil type insulating oils may be supplied at a relatively low cost and in large amounts since they are prepared from petroleum fractions as the principal starting material therefor. The synthetic insulating oils have partly been limited in certain particular uses.

On the other hand, the conventional mineral oil type insulating oils are not such that all of them may be produced from any crude oils without substantial difference in quality therebetween as is the case with gasoline or kerosene. In practice, in order to produce a mineral oil type insulating oil, it is the most important to select a crude oil for the insulating oil; more particularly, there has practically been used, as the crude oil, a naphthene base crude oil which has a certain range of specific gravity, flash point and viscosity as well as a pour point of usually not higher than about −40° C. and a low sulphur content. If a paraffin base, mixed base crude oil or the like is used in substitution for the naphthene base crude oil, a fraction which is obtained by the distillation of the crude oil and is to be used in the preparation of an insulating oil (the fraction usually corresponding to a fraction which is the lightest in weight among all fractions obtained by distillation under a reduced pressure) will usually not have a pour point of as low as approximately −30° C. (According to JIS C-2320-1966, which is a Japanese Industrial Standard, the pour point should be −27.5° C. or lower), thereby making said fraction unsuitable for the production of a desired insulating oil therefrom.

Even in cases where the naphthene base crude oil is used, a desired fraction obtained therefrom by distillation is, per se, not useful as an insulating oil without being subjected to some treatment.

The base oils for the insulating oils obtained from the naphthene base crude oil are, as they are, considerably unsatisfactory in anti-oxidation properties.

In order to overcome this disadvantage, there have been proposed many processes such as processes for incorporating said base oil with mineral oils of different kinds in various amounts (Japanese Patent Gazettes 10133/61, 18584/61 and 3589/66), a process for adding to said base oil an oil obtained by the separation and refinement of the bottoms of a mineral oil (Japanese Patent Gazette 2981/60) and a process for incorporating said base oil with an extract obtained by extraction with solvent (U.S. Pat. No. 3,640,868). These known processes may be applicable to the base oil obtained from the naphthene base crude oil, but not to a base oil obtained from a paraffin base crude oil or a mixed base crude oil. Thus, there have not been any disclosures and reports which teach a process for preparing a satisfactory electrical insulating oil from the paraffin or mixed base crude oil as the starting material.

Since the recent world-wide petroleum panic, on the other hand, the naphthene base crude oils have been remarkably raised in price and have consequently been very difficult to procure at the conventional or a desirably low cost. Therefore, it has been increasingly earnestly sought and required that a satisfactory insulating oil be obtained from the paraffin or mixed base crude oil in place of the naphthene base crude oil, at a lower cost and by the use of a novel process which does not cause environmental pollution, the mixed base crude oil being represented by the Middle Asia-produced crude oil which type is buried underground in large amounts throughout the world.

Since, however, a fraction for an insulating oil obtained from the paraffin or mixed base crude oil has a very high pour point as compared with that obtained from the naphthene base crude oil, an insulating oil having an acceptably low pour point will not be obtained from the paraffin or mixed base crude oil by using such a solvent dewaxing method as used in the purification or refinement of common lubricating oils. As an exception, it would not be impossible to obtain such an insulating oil from the paraffin or mixed crude oil on a laboratory scale by means of solvent dewaxing or urea dewaxing using extreme cooling; however, this method is not suitable to adopt for industrial uses since it is a very economically disadvantageous one. Fractions obtained from the mixed base crude oil typified by the Middle Asia-produced crude oil have a high sulphur content and are therefore unsuitable for the preparation of insulating oils therefrom, while if they are subjected to extreme desulphurization the resulting insulating oils may have not only a low oxidation stability but also a low hydrogen gas absorbency.

As mentioned above, the fractions from the paraffin or mixed base crude oil are not suitable for use as an insulating oil and it has heretofore never been attempted to use them as insulating oils. It has therefore not been known at all what oxidation stability, electrical features and other properties the fractions will exhibit if they are used as an insulating oil.

The present inventors had made intensive studies in attempts to clarify what technical problems must be solved to obtain a satisfactory insulating oil from the paraffin or mixed base crude oil and, as a result, they have found the features or characteristics of a fraction for an insulating oil, obtained from the paraffin or mixed base crude oil. It has further been found by the inventors that there may be obtained a composition having unexpectedly excellent properties as an electrical insulating oil by blending (A) a refined mineral oil obtained by subjecting said fraction for an insulating oil to predetermined refining or purifying treatments, (B) a refined highly aromatic hydrocarbon oil obtained by subjecting a heavy reformed oil produced by reforming hydrocarbons such as naphtha in the presence of a noble metal catalyst, to a predetermined refinement and, if desired, (C) a refined oil obtained by treating a lubricating oil fraction obtained from a mineral oil, with a solid adsorbent.

The "highly aromatic" hydrocarbon oil described herein is one containing at least approximately 50 percent by weight of aromatic hydrocarbons.

In one embodiment, the insulating oil of this invention may be obtained by blending (A) 100 parts by weight of a refined mineral oil having a sulphur content of not higher than 0.5 wt. % , a pour point of from −10° to −25° C. and a nitrogen content of not more than 100 p.p.m., the refined mineral oil being obtained by distilling a paraffin base crude oil or a mixed base crude oil to obtain a fraction containing a distillate having a boiling range of 280° – 400° C. (at atmospheric pressure) and subjecting the thus obtained fraction at least to hydrofining and solvent dewaxing and (B) 5 – 100 parts by weight of a refined highly aromatic hydrocarbon oil obtained by hydrofining and, if required, distilling a fraction containing a distillate having a boiling range of 250° – 400° C. (at atmospheric pressure) produced as a by-product when subjecting hydrocarbons such as naphtha to a reforming reaction at 400° – 600° C. in the presence of a noble metal type catalyst. The "fraction containing oily components having a boiling range of 280° – 200° C." is intended herein to mean a mineral oil containing at least about 80 wt. % of a distillate boiling in the range of 280° – 400° C. with the balance usually being a distillate having a boiling point which is outside said boiling range (280° – 400° C.) but approximate thereto, and the above mentioned fraction is hereinafter expressed by the "fraction having a boiling range of 280° – 400° C." for brevity. In addition, the "fraction containing a distillate having a boiling range of 250° – 400° C." is intended herein to means a heavy fraction containing at least about 80 wt. % of a distillate boiling in the range of 250° – 400° C. with the balance usually being a distillate having a boiling point which is outside said boiling range (250° – 400° C.) but approximate thereto, and the above mentioned fraction is hereinafter expressed by the "fraction having a boiling range of 250° – 400° C." for brevity.

The refined mineral oil (A) has a sulphur content of not higher than 0.5 wt. % . It is desirable, however, that the oil (A) should have as low a sulphur content as possible from the viewpoint of the prevention of corrosion of apparatuses containing the oil (A) by the sulphur contained in the oil (A) and of the improvement of the oil (A) itself in electrical properties as well as from the viewpoint of the prevention of environmental pollution caused by the oil (A) used and left as waste. If, however, the oil (A) be one which has been extremely refined to reduce its sulphur content to as low as not higher than 0.2 wt. % , it would sometimes be considerably difficult to prepare industrially a more high quality insulating oil being capable of being useful under severe sevice conditions and having an acid number of approximately 0.2 KOH mg/g as determined by the JIS C-2101 Oxidation Stability Test, by using as the base oil the oil (A) so extremely refined (containing not higher than 0.2 wt. % of sulphur) in the preparation of the more high quality insulating oil. In order to prepare a satisfactory insulating oil as mentioned in the aforesaid one embodiment of this invention by using as the base oil the oil (A) containing 0.2 wt. % or less sulphur in said preparation, it is required that the highly aromatic oils (B) which are more expensive be also used in considerably large amounts by weight of approximately 100 parts per 100 parts by weight of the base oil (A) in said preparation. It has been further found by the present inventors that a more satisfactory and high quality insulating oil having further improved electrical is obtained by blending the oil (A) containing 0.2 wt. % or less sulphur, the refined highly aromatic hydrocarbon oil (B) and as a third component (C) a refined lubricating oil fraction obtained by treating a lubricating oil fraction of a mineral oil with a solid adsorbent, the three oils (A), (B) and (C) being blended in predetermined ratios.

The lubricating oil fraction as the material for the refined oil (C) is a fraction containing at least about 80 wt. % of a lubricating oil distillate having a boiling range of 230° – 500° C. with the balance being a distillate having a boiling range which is outside said range (230° – 500° C.) and approximate thereto; and the mineral oil from which the lubricating oil fraction is obtainable is a distillate or fraction of a crude petroleum oil.

In another embodiment, the more satisfactory insulating oil of this invention may be obtained by blending (A) 100 parts by weight of a refined mineral oil having a sulphur content of not higher than 0.2 wt. %, a pour point of from −10° to −25° C. and a nitrogen content of not more than 100 p.p.m., the mineral oil being obtained by distilling a paraffin base crude oil or a mixed base crude oil to obtain a fraction having a boiling range of 280° – 400° C. (at atmospheric pressure) and subjecting the thus obtained fraction at least to hydrofining and solvent dewaxing, (B) 5 - 30 parts by weight of a highly aromatic hydrocarbon oil obtained by hydrofining and, if required, distilling a fraction having a boiling range of 250° – 400° C. (at atmospheric pressure, this applying to the boiling points described throughout the specification unless otherwise specified) produced as a by-product when subjecting hydrocarbons such as naphtha to a reforming reaction at 400° – 600° C. in the presence of a noble metal catalyst, and (C) 1 – 15 parts by weight of a refined oil obtained by treating the lubricating oil fraction of a mineral oil with a solid adsorbent.

One feature of this invention resides in the production of an electrical insulating oil mainly from a base oil which is a mineral oil obtained from a paraffin or mixed base crude oil.

Another feature of this invention resides in the production of an insulating oil by hydrofining such a base oil and the like without producing waste material, unlike cases where the base oil and the like are purified by sulphuric acid washing or the like.

A further feature of this invention resides in the production of a refined base oil (A) having predetermined low sulphur and nitrogen contents by subjecting a fraction for an insulating oil, obtained from paraffin or mixed base crude oil, at least to two indispensable refining treatments which are hydrofining and solvent dewaxing to form a refined oil, and also resides in the use of the refined oil as one of the components of an insulating oil having excellent electrical properties and thermal stability.

A further feature of this invention lies in the production of a novel insulating oil by blending in predetermined ratios, said refined base oil (A) from a paraffin or mixed based crude oil with a refined highly aromatic hydrocarbon oil (B) obtained by hydrofining a heavy fraction produced as a by-product at the time of reforming hydrocarbons such as naphtha in the presence of a noble metal catalyst.

A still further feature of this invention is to additionally use a lubricating oil fraction in refined state (C) of a mineral oil in predetermined proportions in the production of a more satisfactory insulating oil when a refined base oil (A) from a paraffin or mixed base crude oil has a sulphur content of not higher than 0.2 wt. %.

This invention will be explained in more detail hereinunder.

Firstly, a paraffin base crude oil or a mixed base crude oil is distilled to obtain a distillate or fraction boiling at 280° - 400° C. The paraffin or mixed base crude oil used herein is one having a pour point of usually higher than −40° C. and more particularly the crude oil is such that its first key distillate or fraction (kerosene fraction) has an API secific gravity of greater than 33 and its second key distillate (boiling at 275° - 300° C. at a reduced pressure of 40 mm of mercury) has an API specific gravity of greater than 20 as is described in "Sekiyu Binran (Handbook on Petroleum)" on page 19, 1972 edition, published by Sekiyu Shunju Co., Ltd., Japan; thus, the crude oil is clearly differentiated from a naphthene base crude oil. Typical of the paraffin base crude oils are a Pennsylvania crude oil, a Minas crude oil and the like; and typical of the mixed (or intermediate) base crude oils are many of the Middle East-produced crude oils such as Arabian light, Arabian medium and Khafju crude oils. The Arabian type crude oils are preferably used in this invention. According to this invention, these crude oils are distilled to obtain a fraction having a boiling range of 280° to 400° C. The distillation may be effected under atmospheric pressure or a reduced pressure. Under atmospheric pressure the aforesaid fraction may be recovered at the lower part of a distilling column by which the crude oil is fractionated, under a reduced pressure the fraction may be recovered at the upper part of the distilling column. The fraction so recovered is then subjected to hydrofining and solvent dewaxing treatments. These two different treatments may be carried out in any desired order: for example, the hydrofining treatment may be conducted prior to the conduct of the solvent dewaxing treatment, or vice versa.

The hydrofining conducted herein is intended to hydrogenate unsaturated bonds, sulphur, nitrogen and the like contained as impurities in a mineral oil, by the use of a suitable catalyst whereby saturated bonds are obtained followed by removal of the hydrogenated impurities from the mineral oil. The catalysts for the hydrogeneration which may usually be used include the metals of Groups IB, VI and VII of the Periodic Table and further include the oxides and sulphides of said metals, these metals as well as the oxides and sulphides therof being each carried on as inorganic solid material such as bauxite, active carbon, diatomaceous earth, zeolite, silica, alumina or silica-alumina. The metallic catalysts carried on the inorganic solid material include cobalt oxides, nickel oxide, molybdenum oxide, tungsten sulphide, nickel sulphide and cobalt sulphide as well as composites of the oxides, composites of the sulphides and mixtures thereof. In the invention there may particularly preferably be used catalysts prepared by preliminaryily sulphurizing nickel oxide or molybdenum oxide carried on an aluminum oxide-containing carrier. The temperatures for hydrofining may be in the range of usually 230° - 400° C., preferably 260° - 360° C. At temperatures lower than that range the hydrofining reaction will not satisfactorily take place and at temperatures higher than that range it will be accompanied with side reactions such as decomposition, this having adverse effects on the color and pour point of the resulting product. Pressures for the hydrofining may be in the range of usually 25 - 150 Kg/cm² Gauge, preferably 35 - 80 Kg/cm² G. In addition, the amounts of hydrogen used for the hydrofining may be in the range of usually 100 - 10,000 Nm³, preferably 200 - 1,000 Nm³, per Kl of mineral oil supplied.

The solvent dewaxing treatment carried out herein is intended to solidfy waxy substances contained in a mineral oil and remove the thus solidified waxy substances therefrom, whereby a refined mineral oil having a desired pour point is obtained. The solvents which may be usually used herein include mixed solvents such as benzene-toluene-acetone and benzene-toluene-methyl ethyl ketone; the former mixed solvent may preferably contain the acetone portion and the aromatic hydrocarbon (benzene and toluene) portion in the ratios by volume of about 30 - 60 : 40 - 70, and the latter may preferably contain methyl ethyl ketone and the aromatic hydrocarbons in the ratios by volume of about 40 - 60 : 40 - 60. The mixing ratio between the mineral oil to be treated and the mixed solvent may be determined by adding the solvent to the mineral oil so that the solution (the oil and the solvent) being supplied to a dewaxing filter is constant in viscosity.

In refining treatments of the mineral oil as material for the refined mineral oil (A) a refining treatment with a solvent and that with clay may preferably be used in combination. The refining treatment with a solvent, herein used, is one which comprises contacting the above mineral oil material with a solvent capable of selectively dissolving liquid sulphur dioxide and aromatic compounds such as furfural and phenol. In this treatment with the solvent, the use of furfural is recommendable, the contact temperature is usually 50° - 100° C., preferably 60° - 90° C., and the solvent and the mineral oil are used in the ratios by volume of 0.3 - 2.0 : 1, preferably 0.5 - 1.7 : 1.

The treatment with clay, herein used, is one which comprises contacting the mineral oil with active clay, acid clay, fuller's earth or the like: and the contact may be effected by a percolation method, a contact method or the like.

In the practice of this invention, the specific fraction containing mineral oil obtained from the paraffin or mixed base crude oil is subjected to the aforesaid refining treatments thereby to obtain the refined mineral oil (A) having a sulphur content of not higher than 0.5 wt. %, preferably not higher than 0.2 wt. %, a pour point of from −10° to −25° C., and a nitrogen content of not more than 100 p.p.m. As mentioned later, if a refined mineral oil has a sulphur content of higher than 0.5 wt. %, then an insulating oil containing said oil will promote the discoloration of the copper plate of an electric appliance in operation wherein the insulating oil is used and will practically corrode the materials from which the electric appliance is made; thus, a non-corrosive insulating oil is not obtained. In addition, it has been found that if a refined mineral oil contains more than 100 p.p.m. of nitrogen, then an insulating oil containing said mineral oil will deteriorate in stability and rapidly deteriorate in electrical properties when used over a long period of time.

If a refined mineral oil has a pour point of higher than −10° C., then an insulating oil containing the mineral oil will not have a satisfactory pour point. If a refined mineral oil having a pour point of lower than −25° C. is attempted to be obtained, then the aforesaid refining treatments, particularly the dewaxing treatment, will have to be severely used to attain this uneasy object, this being not advantageous in the industrial production of a satisfactory insulating oil. It is a matter of course that even if the refined mineral oil (A) according to this invention be singly used as an insulating oil, it will not exhibit the properties (according to the standard prescribed in Japanese Industrial Standard), such as hydrogen gas absorbability and stability against oxidation, required in the insulating oil of this invention.

As stated later, however, if the refined mineral oil (A) is incorporated with the highly aromatic hydrocarbon oil (B) according to this invention and, if the refined mineral oil (A) has a sulphur content of not higher than 0.2 wt. %, with the refined oil (C) prepared by treating a lubricating oil fraction of a mineral oil, the oils (A), (B) and (C) being blended together in the specified ratios, thereby to form a blend, the blend so formed will eliminate said disadvantages and will be a higher quality electrical insulating oil having more satisfactory and excellent properties.

The highly aromatic hydrocarbon oil (B) which is used as a second component in the preparation of the insulating oil of this invention, may be produced by subjecting hydrocarbons, preferably hydrocarbons having a boiling range of 60° – 200° C. such as, for example, straight run gasoline or cracked gasoline, to a reforming reaction at about 500° C. in the presence of a catalyst under pressurized hydrogen and then distilling the thusreformed hydrocarbons thereby to obtain an oil containing a fraction boiling at 250° – 400° C., which oil is the highly aromatic hydrocarbon oil (B). The catalyst used in this reforming reaction is a catalyst made of a noble metal selected from the group consisting of the Platinum Group metals and combinations of each of the Platinum Group metals with at least one of Ge, Sn, Re, Fe, Ni, Pb and halogens, the catalysts being carried on a solid carrier such as alumina or silica-alumina. Moreover, the reforming reaction may be effected under the conditions that the reaction temperature is in the range of 400° – 600° C., the reaction pressure in the range of 10 – 50 atm., the amount of hydrogen circulated 100 – 1500 $Nm^3$ per Kl of raw material (hydrocarbons) and LHSV 0.5 – 5 $hx^{-1}$.

Most of the hydrocarbons contained in the refined highly aromatic hydrocarbon oil (B) herein used have no less than 10 carbon atoms and are each a monocyclic or polycyclic aromatic hydrocarbon; for the purpose of illustration only, the highly aromatic hydrocarbon oil contains alkylbenzenes, alkylnaphthalenes, alkyltetralins and the like as the main ingredients and further contains biphenyl, acenaphthene, fluorene and the like as well as some tricyclic aromatic compounds (a few percent for example). In other words, the highly aromatic hydrocarbon oil may preferably contain about $C_{10}$ — about $C_{18}$ bicyclic and monocyclic aromatic hydrocarbons in amounts by weight of not less than about 50%, more preferably not less than about 90%. It will be preferable if tricyclic and more highly polycyclic aromatic ingredients having a high carbon content have previously been cut as the bottoms since the amount of hydrofining to be subsequently carried out is decreased. The highly aromatic hydrocarbon oil has heretofore been mostly used as part of reformed gasolines and partly used as a solvent and a fuel for the maker which produced the highly aromatic oil.

Recently, the heavy reformed oil for the refluxed highly aromatic hydrocarbon oil (B) has gradually come to be studied to find its utility: it has thus been reported that the heavy reformed oil is alkylated with a lower olefin to form an alkylated oil which may be used as an electrical insulating oil, plastic processing oil, flushing oil, solvent and like material (Japanese Laying - Open Patent Gazettes 43403/73, 13283/73 and 17402/74, for example).

According to this invention, the heavy reformed oil is not subjected to treatments such as alkylation, but subjected only to hydrofining thereby obtaining the highly aromatic hydrocarbon oil (B) as one of the components of the insulating oil of this invention. The production of the highly aromatic oil as a material for the electrical insulating oil will be further detailed hereinunder.

A starting material for the highly aromatic hydrocarbon oil (B) is a heavy fraction containing oily components boiling at 250° – 400° C., the heavy fraction being obtained as a by-product when a hydrocarbon oil such as naphtha is catalytically reformed at 400° – 600° C. in the presence of a noble metal catalyst to produce high octane number gasolines or aromatic hydrocarbons such as benzene, toluene and xylene. Without further treatment the heavy fraction is in color and unstable and is also unsatisfactory in electrical properties, heat resistance, oxidation stability and the like as an electric insulating oil. According to this invention, it has been found that the heavy fraction or distillate hydrofined under specific conditions when blended with the aforesaid refined mineral oil (A) and, if desired, with the aforementioned refined oil (C) derived from the lubricating oil fraction, results in an insulating oil with unexpectedly excellent properties. The catalysts which may be used in the preparation of the highly aromatic hydrocarbon oil (B) may be identical with those which may be used in the hydrofining of the specific mineral oil (A) obtained from the crude oil; the preferable ones include the oxides and sulphides of nickel, cobalt and molybdenum, each carried on an alumina-containing carrier, and the more preferable ones are nickel oxide and molybdenum oxide each preliminarily sulphurized and carried on an alumina carrier. In the hydrofining of the heavy distillate or fraction for the highly aromatic oil (B), there may be used a reaction pressure of 20 – 100 $Kg/cm^2$ Gauge, preferably 25 – 60 $Kg/cm^2$ G.; a reaction temperature of 230° – 400° C., preferably 260° – 350° C.; and an amount of hydrogen of 100 – 10,000 $Nm^3$, preferably 200 – 1,000 $Nm^3$, per Kl of the distillate supplied. The hydrofining in this case is carried out under the condition that a complete nuclear hydrogenation is not effected on the aromatic compounds contained in the distillate supplied. To this end, it is necessary to select catalysts and reaction conditions which may preferably be used in each case.

In the above manner, there is obtained from the heavy fraction a refined highly aromatic hydrocarbon oil (B) having a specific gravity of $d_4^{20}$ 0.980 – 1.000, a refractive index of $n_d^{20}$ 1.56 – 1.60 and a specific dispersion of 220 – 240, which highly aromatic oil may be used as one of the components of the electrical insulating oil of this invention.

The specific mineral oil material obtained from the crude oil and the heavy fraction obtained at the reforming reaction are each necessary to subject to hydrofining in order that they may be used in the preparation of the insulating oil of this invention; in addition, the hydrofining conditions respectively for the mineral oil material and heavy fraction may be approximately identical with each other. Therefore, in cases where said mineral oil material and heavy fraction may be hydrofined separately to obtain the respective specific oils (A) and (B) as the components of the insulating oil of this invention, they may alternatively be blended together in predetermined ratios followed by being hydrofined. The blend so hydrofined may be used as the insulating oil of this invention without further treatment, or it may be incorporated with other component oils according to this invention in predetermined ratios, the component oils having previously been produced separately from those of said hydrofined blend, and/or preferably with the refined lubricating oil fraction (C) according to this invention in predetermined ratios if the specific mineral oil (A) from the crude oil has a sulphur content of not higher than 0.2 wt. %, in order that the resulting mixture may be used as the insulating oil of this invention. The refined lubricating oil fraction (C) has a sulphur content of usually about 0.1 – 2 wt. %, preferably 0.2 – 1.5 wt. %.

In this invention, the refined mineral oil (A) which is the base oil (A), may be incorporated with the highly aromatic oil (B) in the amounts by weight of 5 – 100 parts, preferably 8 – 50 parts, per 100 parts by weight of the oil (A), thus obtaining a satisfactory insulating oil. If the refined mineral oil (A) has a sulphur content of not higher than 0.2 wt. %, it may preferably be incorporated with the highly aromatic oil (B) in the amounts by weight of 5 – 30 parts per 100 parts by weight of the oil (A) and further with the refined lubricating oil fraction (C) in the amounts by weight of 1 – 15 parts per 100 parts by weight of the oil (A), thus also obtaining a more satisfactory and high quality insulating oil. In this case, the highly aromatic oil (B) may be controlled in amount added so that the resulting blend or insulating oil has a pour point of −27.5° C. If the amount of the highly aromatic oil (B) added is less than said 5 parts by weight, then the oil (B) in the resulting blend will be less effective in improving the resulting blend in pour point (although this depends partly upon the pour point of the original oil (B)), hydrogen absorbability and oxidation stability, while if the oil (B) is added in the amounts by weight of 100 parts, then this will not be more effective and will, therefore, be uneconomical.

If, on the other hand, the refined mineral oil (A) which is the base oil (A), contains no more than 0.2 wt. % of sulphur and the refined lubricating oil fraction (C) is added to the oil (A) in the amounts by weight of 1 – 15 parts per 100 parts by weight of the oil (A), the highly aromatic hydrocarbon oil (B) should be added to the oil (A) in the amounts by weight of 5 – 30 parts on the same basis as above to obtain the best result. In this case, if the amount of the oil (B) added is more than 30 parts by weight, it will not further improve the resulting blend in oxidation stability and will, therefore, be uneconomical. The use of less than one part by weight of the oil fraction (C) will make the resulting blend somewhat unsatisfactory in oxidation stability, while the use of more than 15 parts by weight of the oil fraction (C) will raise problems as to the corrosion resistance and thermal stability of the resulting blend. Furthermore, it is preferable that the blend consisting essentially of these three components should have a total sulphur content of not higher than 0.35 wt. %. If the blend has a sulphur content of higher than 0.35 wt. % then it will be unsatisfactory in corrosion resistance and will corrode the copper plate and other metallic materials of an electric appliance in operation wherein it is used, thus raising problems as to its practical use.

In this invention it is more preferable that the blend or insulating oil should have a total sulphur content of from 0.05 to 0.3 wt. %.

This invention will be better understood by the following non-limitative examples for illustration purpose only, in which examples all parts and percentages are by weight unless otherwise specified.

EXAMPLE 1

1. Production of a refined mineral oil (A) — 1 from a mixed base crude oil

A residual oil obtained by distilling a crude oil (Arabian medium) of the Middle East-produced crude oil type at atmospheric pressure, was distilled under a reduced pressure to obtain a fraction having a boiling range of 290° – 400° C. (at atmospheric pressure and this applying to the boiling points described throughout the specification unless otherwise indicated, as defined before) and a pour point of 3° C. The thus obtained fraction which was a starting material for the base oil (A) –1, was firstly treated with furfural (solvent ratio : 150 vol. %, temp. : 50° – 80° C) to obtain a raffinate in a yield of about 70 vol. %. The raffinate so obtained was introduced into a hydrofining apparatus (packed with a commercially available nickelmolybdenum-alumina catalyst) where it was treated with 400 $Nm^3$ of hydrogen per liter of the raffinate at a liquid hourly space velocity (LHSV) of 1.5 and at a reaction temperature of 300° C. and a pressure of 50 $Kg/cm^2$ G. In the usual manner, the raffinate so hydrofined was subjected to stripping thereby removing the low boiling fraction therefrom and introduced into a dewaxing apparatus (mixed solvent : methyl ethyl ketone - toluene, mixing ratio 55 : 45; solvent ratio : 200 vol. %; dewaxing temperature : −30° C.) where it was dewaxed, thus yielding a dewaxed oil having a pour point of −20° C. The dewaxed oil was then treated with clay thereby to obtain a refined mineral oil which was the base oil (A) —1 having the properties as indicated in the following Table 1.

From this Table it was found that the base oil (A) —1 needed improvements in pour point (−27.5° C. or lower) and JIS oxidation stability JIS C-2101 (acid number : 0.6 KOH mg./g. or less; sludge : 0.4% or less) to meet the requirements for JIS No. 2 insulating oil (JIS C-2320-1966). The term "JIS" stands for "Japanese Industrial Standard." It was further found that the base oil (A) –1 is inferior in hydrogen absorbability and heat stability to a commercially available insulating oil derived from a naphthene base crude oil (Table 2, Comparative example).

A highly aromatic hydrocarbon oil (B) –1 was produced as follows, and portions of the base oil (A) –1 were incorporated with the highly aromatic hydrocarbon oil (B) –1 in various mixing ratios thereby to form insulating oils respectively which were then tested for properties with the results being shown in Table 1. Furthermore, it was substantiated that the highly aromatic hydrocarbon oil (B) –1 had less satisfactory effects on a base oil which was the same as the base oil (A) –1 except that it had not been hydrofined, then on the hydrofined base oil (A) –1 thereby to show more clearly the insulating oil of this invention to be excellent.

2. Production of a refined highly aromatic hydrocarbon oil (B) –1

A naphtha was introduced into a catalytic reforming apparatus consisting essentially of multi-stage reaction towers packed with a platinum-rheniumchlorinealumina catalyst (0.3 wt. % Pt, 0.3 wt. % Re, 0.6 wt. % Cl-$\gamma$-$Al_2O_3$), in which towers it was reformed under the conditions that the reaction temperature was 480° – 520° C., the reaction pressure was 15 Kg/cm² G., the amount of hydrogen circulated was 300 Nm³/Kl of oil supplied, and the oil hourly space velocity (LHSV) was 2 $hr^{-1}$, to obtain a reformed oil. The reformed oil so obtained was distilled to collect a fraction having a boiling range of 250° – 400° C., a specific gravity of $d_4^{20}$ 1.0073, a refractive index of $n_d^{20}$ 1.6028, a viscosity of 3.185 cSt at 100° F., an analysis of C, 92.9 wt. % and H, 7.1 wt. %, and distillation characteristics that the 20%, 50% and 90% recovery temperatures were 258°, 275° and 330° C., respectively. The fraction so collected was introduced into a circulation-type tubular reactor packed with a nickel (NiO, 3.0 wt. %) -molybdenum ($MoO_3$, 14 wt. %)-alumina catalyst in which reactor it was hydrofined with 500 Nm³ of hydrogen per Kl of oil at a liquid hourly space velocity (LHSV) of 3 and at a reaction temperature of 300° C. and a reaction pressure of 35 Kg/cm² G. The oil so hydrofined was distilled at a reduced pressure to collect a fraction having a boiling range of 250° – 350° C. which was then treated with 23 Kg of active clay per Kl of oil at 60° C. for 30 minutes thereby to remove the impurities in the fraction therefrom. The oil so treated had a specific gravity of $D_4^{15}$ 0.991, a refractive index of $n_d^{20}$ 1.578, a viscosity of 3.79 at 100° F. or 1.26 at 210° F., a pour point of not higher than −50° C., a flash point of 135° C., an analysis of % $C_A$ 61.8, % $C_N$ 21.8 and % $C_P$ 16.4 as determined by n-d-M analyzing method, and distillation characteristics that the 20%, 50% and 90% recovered temperatures were 267°, 282° and 320° C., respectively.

3. Preparation of an insulating oil

The various portions of the base oil (A) -1 were each blended with the highly aromatic hydrocarbon oil (B)-1, respectively, as indicated in the following Table 1. As is clear from Table 1, the base oil (A)-1 has been found to be remarkably improved in JIS oxidation stability and hydrogen absorbency by being blended with the highly aromatic oil (B) -1 although the oil (A) -1 is, per se, unsatisfactory in said two properties. It has been further found that by being so blended the base oil (A) -1 is also greatly improved in thermal stability as determined by the test for thermal stability (ASTM D-1934), the thermal stability indicating how long the blend or insulating oil may be practically used before the deterioration thereof caused by heat. There has thus been established a process for preparing an electrical insulating coil mainly from a mixed base crude oil.

Table 1

| Kind of oil | | | Example 1 Blend | | (Example) | |
|---|---|---|---|---|---|---|
| | | (A-1) | (A)-1 95 Parts | 90 | 80 | 60 |
| Properties | | Base oil | (B)-1 5 Parts | 10 | 20 | 40 |
| Specific Gravity $d_4^{15}$ | | 0.8531 | 0.8618 | 0.8672 | 0.8818 | 0.9085 |
| Refractive index $n_d^{20}$ | | 1.469 | 1.4743 | 1.4802 | 1.4910 | 1.5125 |
| Kinematic viscosity | | | | | | |
| 100° F | | 10.35 | 9.62 | 9.03 | 8.23 | 6.69 |
| cSt 210° F | | 2.62 | 2.27 | 2.22 | 2.13 | 1.90 |
| Flash point (PM) ° C | | 164 | 162 | 160 | 158 | 150 |
| Pour point ° C | | −20.0 | −30.0 | −32.5 | −32.5 | −35.0 |
| Specific dispersion | | 106 | 111 | 117 | 129 | 154 |
| Sulphur content wt % | | 0.20 | 0.18 | 0.16 | 0.15 | 0.12 |
| Nitrogen content ppm | | 5 | — | — | — | — |
| Electrical properties | Volume resistivity Ω·cm × $10^{14}$ | 12.0 | 11.2 | 10.8 | 9.6 | 7.2 |
| | Dielectric (loss) tangent % | 0.012 | 0.030 | 0.043 | 0.055 | 0.073 |
| | Dielectric constant | 2.06 | 2.10 | 2.14 | 2.21 | 2.33 |
| | Dielectric break-down voltage kV/2.5mm | 58 | 60 | 63 | 64 | 68 |
| JIS*1 oxidation stability | Acid number KOH mg/g | 0.84 | 0.26 | 0.24 | 0.26 | 0.19 |
| | Sludge wt % | 0.13 | 0.08 | 0.13 | 0.22 | 0.16 |
| Thermal stability *2 | Dielectric (loss) tangent (80° C) % | 3.0 | 2.1 | 1.4 | 1.0 | 0.6 |
| | Volume resistivity Ω.cm × $10^{12}$ | 0.8 | 1.4 | 1.6 | 2.8 | 3.6 |
| Hydrogen absorbability (50° C, 8kV)mmHg 60 min | | −16 | −22 | −29 | −41 | −66 |
| Corrosive sulphur test*3 | | 1b | 1b | 1b | 1b | 2a |

*1JIS C-2101 120° C, 75 hr,
*2ASTM D-1934 115° C, 96 hr Cu-Cat,
*3ASTM D-1275-67 140° C, 19 hr

Table 2

| Properties | | (Comparative examples 1 and 2) Kind of oil: Comparative example 1 — Oil dewaxed with furfural (D)-1 | Comparative example 1 — (D)-1 80 Parts / (B)-1 20 Parts | Comparative example 2 — Commercially available nephthene base insulating oil |
|---|---|---|---|---|
| Specific Gravity $d_4^{15}$ | | 0.848 | 0.877 | 0.879 |
| Refractive index $n_d^{20}$ | | 1.4680 | 1.4900 | — |
| Kinematic viscosity 100° F | | 7.28 | 6.58 | 8.00 |
| cSt 210° F | | 2.11 | 1.94 | 2.20 |
| Flash point (PM) ° C | | 154 | 150 | 136 |
| Pour point ° C | | −20.0 | −27.5 | −32.5 |
| Sulphur content wt % | | 0.86 | 0.69 | 0.08 |
| Electrical Properties | Volume resistivity Ω·cm × $10^{14}$ | 2.0 | 1.8 | 17 |
| | Dielectric (loss) tangent % | — | 1.6 | 0.02 |
| | Dielectric constant | — | — | 2.22 |
| | Dielectric breakdown voltage kV/2.5mm | — | — | 60 or less |
| JIS oxidation stability | Acid number KOH mg/g | 0.45 | 0.35 | 0.40 |
| | Sludge wt % | 0.20 | 0.16 | 0.20 |
| Thermal stability | Dielectric (loss) tangent (80° C) % | — | — | 2.0 |
| | Volume resistivity Ω·cm × $10^{12}$ | — | — | 1.0 |
| Hydrogen absorbability (50° C, 8kV)mmHg 60min | | — | −40 | −34 |
| Corrosive sulphur test | | 3a | 2d | 2a |

Comparative Example 1

A fraction having a boiling range of 290° – 400° C was obtained by distilling under a reduced pressure a residual oil obtained by the distillation of a crude oil (Arabia medium) of the Middle East-produced crude oil type at atmospheric pressure, was treated with furfural (solvent ratio : 150 vol. %; temperature : 50° – 80° C.) to obtain about 70% of a raffinate. The raffinate so obtained was, without being hydrofined, introduced into a dewaxing apparatus where it was dewaxed with methyl ethyl ketone-toluene (55 : 45) at a solvent ratio of 200 vol. % and at a temperature of −30° C. Eighty (80) parts of the thus-dewaxed oil (D)–1 as a base oil were incorporated with 20 parts of the highly aromatic oil (B)–1 of Example 1 to obtain an oil blend which was measured for properties as an electrical insulating oil. The results are shown in Table 2.

From this Table it is seen that the addition of the highly aromatic oil (B) to said dewaxed but non-hydrofined base oil will improve the resulting blend in pour point but will deteriorate it in corrosive sulphur and electrical properties thereby to clarify that the blend is not useful as an electrical insulating oil.

EXAMPLE 2

1. Production of the base oils (A)–2 and (A)–3 from a mixed base crude oil

As the starting material, a fraction having a boiling range of 280° – 380° C., was produced by distilling under a reduced pressure a residual oil obtained by the distillation of a crude oil of the Middle East-produced crude oil type at atmospheric pressure. The fraction so produced was firstly dewaxed with a methyl ethyl ketonetoluene solvent (50 : 50) at a solvent ratio of 150% and a dewaxing temperature of −30° C. to obtain a dewaxed oil having a pour point of −25° C. and a sulphur content of 2.18 wt. %. Two portions of the dewaxed oil so obtained were subjected to hydrofining in the presence of the same nickel-molybdenum-alumina catalyst as used in Example 1 under the reaction conditions that the amount of hydrogen supplied was 500 $Nm^3$/Kl of the oil, the hydrogen pressure was 50 Kg/$cm^2$ G., the oil hourly space velocity (per unit volume of catalyst) was 2 (LHSV) and the reaction temperatures were 330° and 370° C. to obtain two hydrofined oils which were subjected to stripping to remove light oil fractions contained in the oils therefrom and were then treated with clay under the same conditions as used in Example 1, thus obtaining a comparative base oil (D)–2 and a base oil (A)–3 according to this invention, respectively. The base oils so obtained were tested for their general properties, and oil blends each containing the base oil as one of the components of the blend in the predetermined ratios as indicated in Table 3 were also tested for properties as an insulating oil. The results are shown in Table 3.

The properties of the base oil (A)–3 which are necessary to improve in view of those of the commercially available naphthene base electrical insulating oil and the JIS No. 2 Standard of electrical insulating oil, are (1) pour point, (2) JIS oxidation stability (particularly, acid number), and (3) thermal stability. It has been found that the pour point and JIS oxidation stability will tend to be decreased if the hydrofining temperature is raised, while the thermal stability will be still unsatisfactory as compared with that of the commercially available naphthene base electrical insulating oil even if the reaction temperature and the degree of hydrofining be raised in the preparation of the base oil (A)–3.

2. Preparation of electrical insulating oil

Portions of the highly aromatic hydrogen oil (B)–1 described in Example 1 were each added to the base oil (370° C. reaction oil, (A)–3 oil) in the ratio described in Table 3 to form a blend which was tested for properties as an insulating oil with the result being shown in Table 3. From the Table it is seen that the base oil (A)–3 will be unexpectedly easily improved in pour point, JIS oxidation stability and thermal stability by being blended with the oil (B)–1 although the oil (A)–3 is originally unsatisfactory in these properties.

In Comparative Example 3, 80 parts of the comparative base oil (D)–2 (330° C. reaction oil; sulphur content, 0.79%) were blended with 20 parts of the highly aromatic oil (B)-1 described in Example 1 to form a blend containing more sulphur than the blends of this invention. The blend so formed was then tested for its properties as an insulating oil with the results being shown in Table 3. From this Table it is seen that the blend having a higher sulphur content than the upper limit (sulphur content, 0.5 wt. %) in the invention, is satisfactory in oxidation stability, pour point and electrical properties but exhibits a very unsatisfactory result (rating, 3*b*) in the corrosive sulphur test, and that it is inferior in thermal stability to the conventional blends.

EXAMPLE 3

Naptha was introduced in series into three reaction towers each packed with a platinum-chlorine-alumina catalyst (0.7 wt. % Pt — 0.7 wt. % Cl — alumina) and hydrofined under the conditions that the reaction temperature was 470° – 530° C., reaction pressure 30 Kg/cm² G., the amount of hydrogen circulated 600 Nm³/Kl of oil supplied, and the feeding rate of naphtha (LHSV) 2 $hr^{-1}$. The reformed oil so obtained was distilled, whereby a fraction having a boiling range of 215° – 360° C was collected. The fraction had the following properties:

Specific gravity: $d_4^{20}$ 0.995; Refractive index: $n_d^{20}$ 1.593; Viscosity: 2.196 cSt at 100° F.; Distillation characteristics: 20%, 50% and 90% recovery temperatures being 244°, 277° and 330° C. respectively.

Twenty parts of this fraction were blended, prior to hydrofining, with 80 parts of the dewaxed and nonhydrofined oil as indicated in Example 2 in Table 3 to form a mixture which was then hydrofined in the presence of the nickel-molybdenum-alumina catalyst as described in Example 1 under the conditions that the reaction pressure was 35 Kg/Cm² G., the reaction temperature 350° C., the liquid hourly space velocity (LHSV) 2, and the amount of hydrogen used 500 Nm³/Kl of the mixed oil fed. The oil so hydrofined was distilled under a reduced pressure whereby a fraction was collected having a boiling range of 270° – 260° C. which was then treated with clay thereby to yield an electrical insulating oil having the following properties:

Specific gravity: $d_4^{20}$ 0.8934; Refractive index: $n_d^{20}$ 1.5024; Viscosity: 4.835 at 100° F.,; Pour point: −30.0° C.; Flash point: 138° C.

The electrical properties of said insulating oil were as follows:

Dielectric constant $\epsilon$ (80° C.): 2.16
Dielectric (loss) tangent % tan $\delta$ (80° C.): 0.03
Volume resistivity $\Omega$ . cm (80° C.): $3.94 \times 10^{14}$
Dielectric breakdown voltage KV/2.5mm: 65
Test for JIS Oxidation stability (JIS — 2101)
120° C., 75 hr:
Sludge wt. % 0.13
Acid number KOH mg/g. 0.27

From the above results it is clear that a very satisfactory insulating oil of this invention will also be obtained even if both the non-hydrofined raw oils are blended together prior to the hydrofining thereof.

EXAMPLE 4

A starting oil was produced by distilling under a reduced pressure a residual oil obtained by the distillation of a Sumatra crude oil (paraffin base crude oil) at atmospheric pressure. The thus produced starting oil or fraction having a boiling range of 295° – 372° C. (carbon ring analysis: % $C_A$ 12.5, % $C_N$ 21.9, % $C_P$ 45.6) was treated with furfural at a solvent ratio of 100% and a temperature of 50° – 70° to obtain a raffinate which was then hydrofined in the presence of a cobalt-molybdenum-alumina catalyst (3% CoO – 15% $MoO_3$) under the conditions that the reaction temperature was 300° C., the partial pressure of hydrogen 35 Kg/cm² G., the liquid hourly space velocity (LHSV) 3 $hr^{-1}$ and the amount of hydrogen used 360 Nm³/Kl of the raffinate fed. The thus hydrofined oil was then dewaxed with a solvent system consisting of methyl ethyl ketone and toluene in the ratio of 65 : 35, at a temperature of −30° C. to obtain a base oil (A)–4 having the properties as indicated in Table 4. The base oil (A)–4 was measured for electrical properties with the results that its JIS oxidation stability and hydrogen absorbability were unsatisfactory and it therefore failed to pass the Standard for JIS No. 2 Insulating Oil.

On the other hand, three portions of the base oil (A)–4 were blended with the various amounts of the highly aromatic oil (B)–1 as described in Example 1 to form three blends which were then tested for properties with the results being shown in Table 4. From the Table it has been found for the first time that the base oil (A)–4 was remarkably improved in pour point, JIS oxidation stability, hydrogen absorbability and other properties in question, and thus, an excellent electrical insulating oil was obtained from a paraffin base crude oil.

Table 3

| Kind of oil | (Example 2, Comparative example 3) | | | | | | |
|---|---|---|---|---|---|---|---|
| | | Hydrofined oil | | Blend (Example) | | | Comparative example 3 |
| | Dewaxed oil Material to | (D)-2 Reaction | (A)-8 Reaction | (A)-3 oil 85 | 70 | 55 | (D)-2 oil 80 |
| Properties | be hydro-fined | temp. 330° C | temp. 370° C | (B)-1 15 | 30 | (B)-1 oil 45 | 20 |
| Specific Gravity $d_4^{15}$ | 0.8871 | 0.8725 | 0.8663 | 0.8850 | 0.9036 | 0.9228 | 0.8961 |
| Refractive index $n_d^{20}$ | 1.4982 | 1.4890 | 1.4853 | 1.4992 | 1.5132 | 1.5271 | 1.5068 |
| Kinematic viscosity 100° F | 6.615 | 6.074 | 5.742 | 5.449 | 5.155 | 4.861 | 5.616 |
| cSt 210° F | 1.905 | 1.817 | 1.754 | 1.680 | 1.605 | 1.530 | 1.705 |

Table 3-continued

| Kind of oil | | (Example 2, Comparative example 3) | | | | | | Comparative example 3 |
|---|---|---|---|---|---|---|---|---|
| | | Dewaxed oil Material to be hydrofined | Hydrofined oil (D)-2 Reaction temp. 330° C | Hydrofined oil (A)-8 Reaction temp. 370° C | Blend (Example) (A)-3 oil 85 / (B)-1 15 | 70 / 30 | 55 / (B)-1 oil 45 | (D)-2 oil 80 / 20 |
| Properties | | | | | | | | |
| Flash point (PM) ° C | | 140 | 138 | 136 | 136 | 135 | 135 | 136 |
| Pour point ° C | | −25.0 | −25.0 | −22.5 | −27.5 | −30.0 | −32.5 | −30.0 |
| Specific dispersion | | 141 | 138 | 149 | 162 | 176 | 156 | |
| Sulphur content wt % | | 2.18 | 0.79 | 0.17 | 0.14 | 0.12 | 0.09 | 0.63 |
| Nitrogen content ppm | | 160 | 60 | 20 | 19 | 16 | 13 | 49 |
| Carbon ring analysis | % Ca | 24.6 | 19.5 | 18.2 | 24.7 | 31.3 | 37.8 | 28.0 |
| | % Cn | 18.5 | 24.2 | 24.0 | 23.7 | 23.3 | 23.0 | 23.7 |
| | % Cp | 56.5 | 56.3 | 57.8 | 51.6 | 46.4 | 40.2 | 49.3 |
| Electrical properties | Volume resistivity Ω. cm × $10^{14}$ | — | 3.48 | 6.0 | 5.25 | 4.50 | 3.75 | 2.93 |
| | Dielectric (loss) tangent % | — | 0.03 | 0.02 | 0.025 | 0.03 | 0.04 | 0.04 |
| | Dielectric constant | — | — | — | — | — | — | — |
| | Dielectric breakdown voltage kV/2.5mm | — | 60 | 60 | 62 | 64 | 66 | 64 |
| JIS oxidation stability | Acid number KOH mg/g | — | 0.57 | 0.80 | 0.25 | 0.26 | 0.28 | 0.25 |
| | Sludge wt % | — | 0.22 | 0.15 | 0.18 | 0.17 | 0.15 | 0.22 |
| Thermal stability | Dielectric (loss) tangent (80° C) % | — | — | 3.2 | 1.5 | 1.2 | 0.9 | 4.0 |
| | Volume resistivity Ω. cm × $10^{12}$ | — | — | 0.8 | 1.2 | 1.5 | 1.7 | 2.0 |
| Hydrogen absorbability (50° C, 8kV)mmHg 60min | | — | −35 | −32 | −49 | −65 | −82 | −57 |
| Corrosive sulphur test | | — | 3a | 2b | 2a | 2a | 2a | 3b |

Table 4

| Kind of oil | | (Example 4) | Blend | | |
|---|---|---|---|---|---|
| | | | (A)-4 oil 85 / (B)-1 oil 15 | 70 / 30 | 55 / 45 |
| Properties | | (A)-4 oil (Base oil) | | | |
| Specific Gravity $d_4^{15}$ | | 0.839 | 0.862 | 0.885 | 0.908 |
| Refractive index $n_d^{20}$ | | 1.462 | 1.479 | 1.497 | 1.514 |
| Kinematic viscosity 100° F | | 10.35 | 9.37 | 8.38 | 7.40 |
| cSt 210° F | | 2.62 | 2.42 | 2.21 | 2.01 |
| Flash point (PM) ° C | | 142 | 138 | 137 | 136 |
| Pour point ° C | | −22.5 | −27.5 | −30.0 | −30.0 |
| Specific dispersion | | 102 | 121 | 139 | 158 |
| Sulphur content wt % | | 0.04 | 0.03 | 0.03 | 0.02 |
| Carbon ring analysis | % $C_a$ | 6.4 | 14.7 | 23.0 | 31.3 |
| | % $C_n$ | 25.2 | 24.7 | 24.2 | 23.7 |
| | % $C_p$ | 68.6 | 61.6 | 52.8 | 46.0 |
| Electrical properties | Volume resistivity Ω·cm × $10^{14}$ | 5.8 | 5.1 | 4.4 | 3.6 |
| | Dielectric (loss) tangent % | 0.012 | 0.04 | 0.07 | 0.10 |
| | Dielectric breakdown voltage kV/2.5mm | 65 | 66 | 67 | 69 |
| JIS oxidation stability | Acid number KOH mg/g | 1.05 | 0.42 | 0.40 | 0.40 |
| | Sludge wt % | 0.15 | 0.09 | 0.11 | 0.13 |
| Thermal stability | Dielectric (loss) tangent (80° C) % | 2.5 | 2.2 | 2.0 | 1.9 |
| | Volume resistivity Ω·cm × $10^{12}$ | 0.7 | 0.9 | 0.9 | 1.2 |
| Hydrogen absorbability (50° C, 8kV)mmHg 60min | | −15 | −34 | −53 | −73 |

EXAMPLE 5

1. Production of a base oil (A)-5 from a mixed base crude oil

The procedure of Example 1 was followed except that the starting fraction had a boiling range of 290° - 396° C., the reaction temperature was 320° C. and the LHSV was 1.0, to obtain a base oil (A)-5 the properties of which are as shown in Table 5.

In order to obtain a more satisfactory and high quality electrical insulating oil than the oil (A)-5 as an electrical insulating oil, it was found that the oil (A)-5 had to be improved in pour point (not higher than −27.5° C.) and JIS oxidation stability (acid number, not more than 0.2 KOH mg/g; sludge, not more than 0.15 wt.%).

2. Production of a highly aromatic oil (B)-1 from a heavy reformed oil

The highly aromatic oil (B)-1 described in Example 1 was used in this Example.

3. Production of a refined oil (C)-1 by the treatment of the lubricating oil fractions of a mineral oil with a solid adsorbent The aforesaid fraction obtained by the distillation at the reduced pressure as indicated in the previous paragraph (1), was treated with furfural at a solvent ratio of 160 vol. % and a temperature of 50°-80° C. to obtain a raffinate which was dewaxed and treated with clay as the base oil (A)-5, whereby a refined oil (C)-1 was obtained.

4. Preparation of electrical insulating oils

Each of portions of the highly aromatic hydrocarbon oil (B)-1 described in Example 1 and each of portions of the refined oil (C)-1 were added to the base oil (A)-5 described above in the ratios described in Table 5 to form a blend which was tested for general properties as an insulating oil with the result being shown in Table 5. From this Table it is seen that the base oil (A)-5 will be more remarkably improved in JIS oxidation stability, pour point and hydrogen absorbability when blended with the oils (B)-1 and (C)-1 in the predetermined ratios than when blended with the oil (B)-1 alone or the oil (C)-1 alone. It is further seen from Table 5 that by being blended with both the oils (B)-1 and (C)-1 the base oil (A)-5 is also greatly improved in thermal stability (ASTM D-1934).

Comparative Example 4

In this Comparative example the base oil (A)-5 was blended with the oil (C)-1 in the ratio of 95 parts to 5 parts to form a blend which was tested for its properties. The results are shown in Table 5. From this Table it is seen that the base oil (A)-5 was considerably improved in oxidation stability by being blended with the oil (C)-1 but the base oil was further better improved not only in oxidation stability but also in hydrogen absorbability, pour point and the like by being blended with both the oil (B)-1 and the oil (C)-1.

Comparative Example 5

Ninety parts of the base oil (A)-5 was blended with 10 parts of the oil (B)-1. The resulting blend was tested for its properties as an insulating oil with the results being indicated in Table 5. From this Table it is seen that the base oil (A)-5 was considerably improved in oxidation stability by being blended with the oil (B)-1 alone while the base oil was further better improved in oxidation and the like by being blended with the oils (B)-1 and (C)-1.

Table 5

| | | | | Blend(Example-5) example 4 | | | | Comparative example 5 | Comparative |
|---|---|---|---|---|---|---|---|---|---|
| | (A)-5 base oil | | | 90 | 85 | 80 | 75 | 95 | 90 |
| | (B)-1 oil | | (A)-5 | 5 | 10 | 15 | 20 | 0 | 10 |
| | (C)-1 oil | | Base oil | 5 | 5 | 5 | 5 | 5 | 0 |
| JIS C - 2320 (1974) ITEMS | Specific gravity (20/4° C) | | 0.835 | 0.844 | 0.852 | 0.875 | 0.869 | 0.836 | 0.852 |
| | Viscosity cSt | (30° C) | 7.42 | 7.40 | 7.24 | 7.07 | 6.91 | 7.56 | 7.10 |
| | | (75° C) | 1.46 | 1.56 | 1.57 | 1.58 | 1.59 | 1.55 | 1.49 |
| | Pour point ° C | | −25 | −27.5 | −27.5 | −30 | −32.5 | −25 | −27.5 |
| | Flash point (PM)° C | | 144 | 140 | 142 | 144 | 146 | 144 | 140 |
| | Amount evaporated Wt % | | 0.17 | 0.21 | 0.20 | 0.17 | 0.15 | 0.15 | 0.20 |
| | Specific dispersion (25° C) | | 104 | 111 | 117 | 123 | 130 | 105 | 117 |
| | Reaction | | Neutral | Neutral | Neutral | Neutral | Neutral | Neutral | Neutral |
| | Total acid number KOHmg/g | | 0.00 | 0.00 | 0.00 | 0.00 | 0.00 | 0.00 | 0.00 |
| | Corrosion (100° C × 3 hr) | | 1b | 1b | 1b | 1a | 1a | 1b | 1b |
| | Oxidation stability | Acid number KOHmg/g | 2.03 | 0.19 | 0.18 | 0.18 | 0.19 | 0.49 | 0.56 |
| | | Sludge Wt % | 0.30 | 0.02 | 0.03 | 0.06 | 0.09 | 0.10 | 0.10 |
| | Dielectric breakdown voltage KV | | 65 | 68 | 70 | 75 | 80 | 60 | 73 |
| | Dielectric (loss) tangent (80° C) % | | 0.000 | 0.002 | 0.002 | 0.000 | 0.001 | 0.008 | 0.001 |
| | Volume resistivity (80° C)Ω-cm | | $2.3\times10^{15}$ | $4.65\times10^{14}$ | $5.95\times10^{14}$ | $6.14\times10^{14}$ | $7.01\times10^{14}$ | $3.6\times10^{14}$ | $6.30\times10^{14}$ |
| | Dielectric constant (80° C) | | 2.05 | 2.10 | 2.16 | 2.23 | 2.26 | 2.05 | 2.20 |
| | Color (Saybolt) | | +26 | +22 | +24 | +26 | +26 | +15 | +26 |
| | Aniline point ° C | | 90.6 | 84.9 | 81.6 | 78.0 | 74.4 | 89.3 | 81.3 |
| | Sulphur content Wt % | | <0.05 | 0.052 | 0.047 | 0.041 | 0.036 | 0.06 | 0.05 |
| | Nitrogen content ppm | | 1.5 | <1 | 1.0 | <1 | <1 | 2.3 | <1 |
| | ASTMD-1934 (115° C×96 hr) No catalyst | Dielectric (loss) tangent | | | | | | | |

Table 5-continued

| | | | Blend(Example-5) example 4 | | | | Comparative example 5 | Comparative |
|---|---|---|---|---|---|---|---|---|
| (A)-5 base oil | | | 90 | 85 | 80 | 75 | 95 | 90 |
| (B)-1 oil | | (A)-5 | 5 | 10 | 15 | 20 | 0 | 10 |
| (C)-1 oil | | Base oil | 5 | 5 | 5 | 5 | 5 | 0 |
| present | (80° C) % | 0.83 | 0.533 | 0.242 | 0.223 | 0.201 | 0.632 | 0.736 |
| | Volume resistivity (80° C) Ω-cm | $8.0\times10^{12}$ | $9.3\times10^{12}$ | $2.5\times10^{13}$ | $34\times10^{13}$ | $4.3\times10^{13}$ | $8.6\times10^{12}$ | $8.3\times10^{12}$ |
| Hydrogen absorbability (8KV×50° C) 150–50min mmoil | | −14 | −37 | −71 | −102 | −134 | −16 | −106 |

EXAMPLE 6

1. Production of a base oil (A)–6 from a mixed base crude oil

The procedure of Example 1 was followed except that the dewaxed oil had a sulphur content of 2.18 wt. %, the hydrogen pressure was 70 Kg/cm² g., the hydrogenating reaction temperature 340° C. and the LHSV 0.7, thereby to obtain a base oil (A)–6. The base oil so obtained was then tested for its properties as an electrical insulating oil with the results being in Table 6. From this Table it is seen that the base oil (A)–6 required to be improved in pour point, JIS oxidation stability (particularly, acid number) and thermal stability. It has been found that an increase in the hydrogenating reaction temperature will tend to deteriorate the resulting base oil in JIS oxidation stability and that the temperature increase will result in the production of an increasingly refined base oil which is still inferior in thermal stability to commercially available electrical insulating oils of a naphthene base.

2. Production of a refined oil (C)–2 by the treatment of the lubricating fraction of a mineral oil with a solid absorbent The dewaxed oil described in paragraph (1) of Example 6 was, without being hydrofined, treated with clay by the use of the method described in Example 1 thereby to obtain a refined oil (C)–2.

3. Preparation of electrical insulating oils

The procedure of paragraph (2) of Example 2 was followed except that the base oil (A)–6 was used as the base oil and the refined oil (C)-2 was used in addition to the highly aromatic oil (B)–1. The blends thus obtained were tested for their properties as an electrical insulating oil. The results are shown in Table 6 from which it is seen that the base oil (A)–6 was unexpectedly easily improved in pour point, JIS oxidation stability and thermal stability by being blended with the oils (B)–1 and (C)–2 although said base oil had originally been unsatisfactory in these properties.

EXAMPLE 7

The procedure of Example 4 was repeated except that the refined oil (C)–1 was additionally blended with the base oil (A)–4 descrbed in Example 4, thereby to obtain blends consisting of the three different oils. The blends so obtained were tested for their properties as an electrical insulating oil. The results are approximately the same as those obtained in Example 6, as shown in Table 7. It has thus been found that excellent and high quality electrical insulating oils may be obtained from a paraffin base crude oil.

Comparative Example 6.

For comparison, the base oil (A)–4 as used in Example 7 was blended only with the oil (B)–1 to form a blend which was then tested for its properties as an electrical insulating oil, with the results being shown in Table. 7. This Table shows that the base oil was considerably improved in JIS oxidation stability by being blended only with the oil (B)–1 but it was further improved in various properties by being blended with the three different oils.

Table 6

| | | | Dewaxed oil Material to be hydrofined | Hydrofined oil (A) - 6 Reaction temp. 340° C | Blend (Example 6) (A)-6 oil 85 (B)-1 oil 10 (C)-2 oil 5 | (A)-6 oil 75 (B)-1 oil 20 (C)-2 oil 5 |
|---|---|---|---|---|---|---|
| JIS C-2320 (1974) ITEMS | Specific gravity (20/4° C) | | 0.881 | 0.856 | 0.870 | 0.884 |
| | Viscosity cSt | (30° C) | 8.20 | 7.00 | 6.78 | 6.50 |
| | | (75° C) | 2.70 | 2.50 | 2.42 | 2.34 |
| | Pour point ° C | | −25 | −22.5 | −27.5 | −30.0 |
| | Flash point (PM)° C | | 140 | 146 | 142 | 140 |
| | Amount evaporated Wt % | | 0.11 | 0.15 | 0.20 | 0.21 |
| | Specific dispersion (25° C) | | 141 | 114 | 126 | 136 |
| | Reaction | | Neutral | Neutral | Neutral | Neutral |
| | Total acid number KOHmg/g | | 0.09 | 0.00 | 0.00 | 0.00 |
| | Corrosion (100° C × 3 hr) | | — | — | — | — |
| | Oxidation stability | Acid number KOHmg/g | — | 3.65 | 0.17 | 0.19 |
| | | Sludge Wt % | — | 1.19 | 0.06 | 0.08 |

Table 6-continued

| | Dewaxed oil Material to be hydrofined | Hydrofined oil (A) - 6 Reaction temp. 340° C | Blend (Example 6) (A)-6 oil 85 (B)-1 oil 10 (C)-2 oil 5 | (A)-6 oil 75 (B)-1 oil 20 (C)-2 oil 5 |
|---|---|---|---|---|
| Dielectric breakdown voltage KV | — | 65 | 85 | 88 |
| Dielectric (loss) tangent (80° C) % | — | 0.008 | 0.006 | 0.005 |
| Volume resistivity (80° C)Ω-cm | — | $5.6 \times 10^{14}$ | $8.3 \times 10^{15}$ | $9.2 \times 10^{15}$ |
| Dielectric constant (80° C) | — | 2.08 | 2.18 | 2.28 |
| Color (Saybolt) | −16 | +30 | +28 | +28 |
| Aniline point ° C | 61.8 | 74.2 | 67.4 | 60.9 |
| Sulphur content Wt % | 2.15 | <0.05 | 0.125 | 0.108 |
| Nitrogen content ppm | 180 | <2 | 11 | 10 |
| ASTMD-1934 (115° C×96 hr) No catalyst present — Dielectric (loss) tangent (80° C) % | — | 0.187 | 0.162 | 0.157 |
| Volume resistivity (80° C) Ω-cm | — | $2.0 \times 2.0 \times 10^{13}$ | $2.6 \times 10^{13}$ | $3.2 \times 10^{13}$ |
| Hydrogen absorbability (8KV×50° C) 150–50min mmoil | — | 31 | −127 | −156 |

Table 7

| | | (A)-4 oil Base oil | Blend (Example 7) 82 10 8 | 77 15 8 | 72 20 8 | Comparative example 6 90 10 0 |
|---|---|---|---|---|---|---|
| JIS C-2320 (1974) ITEMS | Specific gravity (20/4° C) | 0.836 | 0.853 | 0.861 | 0.870 | 0.853 |
| | Viscosity cSt (30° C) | 13.82 | 12.57 | 12.08 | 11.60 | 12.86 |
| | Viscosity cSt (75° C) | 4.03 | 3.74 | 3.62 | 3.50 | 3.79 |
| | Pour point ° C | −22.5 | −27.5 | −27.5 | −30 | −27.5 |
| | Flash point (PM)° C | 142 | 142 | 140 | 140 | 142 |
| | Amount evaporated Wt % | 0.13 | 0.19 | 0.20 | 0.21 | 0.20 |
| | Specific diapersion (25° C) | 102 | 116 | 122 | 128 | 115 |
| | Reaction | Neutral | Neutral | Neutral | Neutral | Neutral |
| | Total acid number KOHmg/g | 0.00 | 0.00 | 0.00 | 0.00 | 0.00 |
| | Oxidation stability — Acid number KOHmg/g | 1.05 | 0.20 | 0.19 | 0.19 | 0.42 |
| | Oxidation stability — Sludge Wt % | 0.15 | 0.07 | 0.06 | 0.05 | 0.13 |
| | Dielectric breakdown voltage KV | 0.05 | 75 | 82 | 85 | 65 |
| | Dielectric (loss) tangent (80° C) % | 0.012 | 0.02 | 0.04 | 0.08 | 0.04 |
| | Volume resistivity (80° C)Ω-cm | $5.8 \times 10^{14}$ | $5.2 \times 10^{14}$ | $5.1 \times 10^{14}$ | $4.9 \times 10^{14}$ | $5.1 \times 10^{14}$ |
| | Dielectric constant (80° C) | 2.00 | 2.07 | 2.11 | 2.05 | 2.25 |
| | Color (Saybolt) | +30 | +25 | +25 | +26 | +26 |
| | Sulphur content Wt % | 0.04 | 0.08 | 0.09 | 0.08 | 0.04 |
| | ASTMD-1934 (115° C×96 hr) No catalyst present — Dielectric (loss) tangent (80° C) % | 2.5 | 0.533 | 0.363 | 0.307 | 1.9 |
| | Volume resistivity (80° C) | $7.0 \times 10^{11}$ | $9.6 \times 10^{13}$ | $1.2 \times 10^{13}$ | $2.1 \times 10^{13}$ | $1.2 \times 10^{12}$ |
| | Hydrogen absorbability (8KV×50° C) 150–50min mmoil | −15 | −65 | −83 | −103 | −65 |

What is claimed is:

1. An electrical insulating oil consisting essentially of (I) 100 parts by weight of a mineral oil (A) having a sulphur content of not higher than 0.5 wt. %, a pour point of from −10° to −25° C. and a nitrogen content of not more than 100 p.p.m., the mineral oil (A) being prepared by subjecting at at least to hydrofining and solvent dewaxing a fraction containing a distillate having a boiling range of 280° - 400° C. at atmospheric pressure, the fraction being obtained by the distillation of a paraffin base crude oil or a mixed base crude oil and (II) 5 - 100 parts by weight of a highly aromatic hydrocarbon oil (B) prepared by hydrofining a fraction having a boiling range of 250° - 400° C. at atmospheric pressure, the fraction being produced as a by-product of subjecting naphtha hydrocarbons to reforming reaction at temperatures of 400° - 600° C. in the presence of a catalyst selected from the group consisting of the Platinum Group metals and combinations of each of the Platinum Group metals with at least one of Ge, Sn, Re, Fe, Ni, Pb and halogens.

2. An electrical insulating oil consisting essentially of (I) 100 parts by weight of a mineral oil (A) having a sulphur content of not higher than 0.2 wt. %, a pour point of from −10° to −25° C. and a nitrogen content of not more than 100 p.p.m., the mineral oil (A) being prepared by subjecting at least to hydrofining and solvent dewaxing a fraction having a boiling range of 280° - 400° C. at atmospheric pressure, the fraction being obtained by the distillation of a paraffin base crude oil or a mixed base crude oil, (II) 5 - 30 parts by weight of a highly aromatic hydrocarbon oil (B) prepared by hydrofining a fraction having a boiling range of 250° - 400° C. at atmospheric pressure, the fraction being produced as a by-product of subjecting naphtha hydrocarbons to reforming reaction at temperatures of 400° - 600° C. in the presence of a catalyst selected from the group consisting of the Platinum Group metals and combinations of each of the Platinum Group metals with at least one of Ge, Sn, Re, Fe, Ni, Pb and halogens, and (III) 1 - 15 parts by weight of a refined oil (C) prepared by treating the lubricating oil fraction of a mineral oil with a solid absorbent.

3. An electrical insulating oil according to claim 1, wherein the hydrocarbons to be subjected to the reforming reaction are those boiling in the range of 60° - 200° C.

4. An electrical insulating oil according to claim 2, wherein the hydrocarbons to be subjected to the reforming reaction are those boiling in the range of 60° - 200° C.

5. An electrical insulating oil according to claim 2, wherein the lubricating oil fraction as the material for the refined oil (C) is one having a boiling range of 230° - 500° C.

6. An electrical insulating oil according to claim 1, wherein the highly aromatic hydrocarbon oil (B) contains not less than about 50% by weight of about $C_{10}$ to about $C_{18}$ bicyclic and monocyclic aromatic hydrocarbon.

7. An electrical insulating oil according to claim 1, wherein the highly aromatic hydrocarbon oil (B) contains not less than about 90% by weight of about $C_{10}$ to about $C_{18}$ bicyclic and monocyclic aromatic hydrocarbon.

8. An electrical insulating oil according to claim 2, wherein the highly aromatic hydrocarbon oil (B) contains not less than about 50% by weight of about $C_{10}$ to about $C_{18}$ bicyclic and monocyclic aromatic hydrocarbon.

9. An electrical insulating oil according to claim 2, wherein the highly aromatic hydrocarbon oil (B) contains not less than about 90% by weight of about $C_{10}$ to about $C_{18}$ bicyclic and monocyclic aromatic hydrocarbon.

10. An electrical insulating oil according to claim 6, wherein the highly aromatic hydrocarbon oil (B) has a specific gravity of $d_4^{20}$ 0.980 - 1.000, a refractive index of $n_d^{20}$ 1.56 - 1.60 and a specific dispersion of 220 - 240.

11. An electrical insulating oil according to claim 7, wherein the highly aromatic hydrocarbon oil (B) has a specific gravity of $d_4^{20}$ 0.980 - 1.000, a refractive index of $n_d^{20}$ 1.56 - 1.60 and a specific dispersion of 220 - 240.

12. An electrical insulating oil according to claim 8, wherein the highly aromatic hydrocarbon oil (B) has a specific gravity of $d_4^{20}$ 0.980 - 1.000, a refractive index of $n_d^{20}$ 1.56 - 1.60 and a specific dispersion of 220 - 240.

13. An electrical insulating oil according to claim 9, wherein the highly aromatic hydrocarbon oil (B) has a specific gravity of $d_4^{20}$ 0.980 - 1.000, a refractive index of $n_d^{20}$ 1.56 - 1.60 and a specific dispersion of 220 - 240.

14. An electrical insulating oil according to claim 1, containing 8 - 50 parts by weight of highly aromatic hydrocarbon oil (B) per 100 parts by weight of mineral oil (A).

15. An electrical insulating oil according to claim 1, wherein mineral oil (A) has a sulphur content higher than 0.2 wt. %.

16. An electrical insulating oil according to claim 2, wherein the refined oil (C) has a sulphur content of about 0.1 - 2 wt. %.

17. An electrical insulating oil according to claim 2, wherein the refined oil (C) has a sulphur content of about 0.2 - 1.5 wt. %.

18. An electrical insulating oil according to claim 2, containing not higher than 0.35 wt. % sulphur.

19. An electrical insulating oil according to claim 18, containing 0.05 to 0.3 wt. % sulphur.

20. An electrical insulating oil consisting essentially of (I) 100 parts by weight of a mineral oil (A) having a sulphur content of not higher than 0.5 wt. %, a pour point of from −10° to −25° C. and a nitrogen content of not more than 100 p.p.m., the mineral oil (A) being prepared by subjecting at least to hydrofining and solvent dewaxing a fraction containing a distillate having a boiling range of 280° - 400° C. at atmospheric pressure, the fraction being obtained by the distillation of a paraffin base crude oil or a mixed base crude oil and (II) 5 - 100 parts by weight of a highly aromatic hydrocarbon oil (B) prepared by hydrofining a fraction having a boiling range of 250° - 400° C. at atmospheric pressure, the fraction being produced as a by-product of subjecting naphtha hydrocarbons to reforming reaction at temperatures of 400° - 600° C. in the presence of a Group VIII noble metal catalyst.

21. An electrical insulating oil consisting essentially of (I) 100 parts by weight of a mineral oil (A) having a sulphur content of not higher than 0.2 wt. %, a pour point of from −10° to −25° C. and a nitrogen content of not more than 100 p.p.m., the mineral oil (A) being prepared by subjecting at least to hydrofining and solvent dewaxing a fraction having a boiling range of 280° - 400° C. at atmospheric pressure, the fraction being obtained by the distillation of a paraffin base crude oil or a mixed base crude oil, (II) 5 - 30 parts by weight of a highly aromatic hydrocarbon oil (B) prepared by hydrofining a fraction having a boiling range of 250° - 400° C. at atmospheric pressure, the fraction being produced as a by-product of subjecting naphtha hydrocarbons to reforming reaction at temperatures of 400° - 600° C. in the presence of Group VIII noble metal catalyst, and (III) 1 - 15 parts by weight of a refined oil (C) prepared by treating the lubricating oil fraction of a mineral oil with a solid adsorbent.

* * * * *